US008424346B2

(12) United States Patent
Ki Chul

(10) Patent No.: US 8,424,346 B2
(45) Date of Patent: Apr. 23, 2013

(54) STRUCTURE OF WATER LEVEL SENSOR FOR STEAM GENERATOR IN DRUM WASHING MACHINE

(75) Inventor: Cho Ki Chul, Masan-si (KR)

(73) Assignee: LG Electronics Inc., Seoul (KR)

( * ) Notice: Subject to any disclaimer, the term of this patent is extended or adjusted under 35 U.S.C. 154(b) by 982 days.

(21) Appl. No.: 11/660,097

(22) PCT Filed: Mar. 15, 2006

(86) PCT No.: PCT/KR2006/000919

§ 371 (c)(1),
(2), (4) Date: Mar. 12, 2008

(87) PCT Pub. No.: WO2006/126778

PCT Pub. Date: Nov. 30, 2006

(65) Prior Publication Data

US 2009/0007603 A1 Jan. 8, 2009

(30) Foreign Application Priority Data

May 23, 2005 (KR) ..... 10-2005-0042997
May 23, 2005 (KR) ..... 20-2005-0014480 U
May 23, 2005 (KR) ..... 20-2005-0014484 U

(51) Int. Cl.
*D06F 39/04* (2006.01)

(52) U.S. Cl.
USPC ..... 68/5 R; 68/15; 68/207

(58) Field of Classification Search ..... 68/5 R
See application file for complete search history.

(56) References Cited

U.S. PATENT DOCUMENTS

2004/0255391 A1 12/2004 Kim et al.
2005/0034487 A1 * 2/2005 Oh et al. ..... 68/5 C

FOREIGN PATENT DOCUMENTS

| | | | |
|---|---|---|---|
| CN | 2295115 | | 10/1998 |
| EP | 1507029 | A2 | 2/2005 |
| EP | 1507032 | A1 | 2/2005 |
| JP | 2005-058740 | | 3/2005 |
| KR | 10-2004-0085509 | A | 10/2004 |
| KR | 2005-0108788 | * | 11/2005 |
| WO | WO2006-098572 | A1 * | 3/2006 |
| WO | WO/2006/098572 | A1 * | 3/2006 |

OTHER PUBLICATIONS

English machine translation of KR-10-2005-0108788 to Kim.*

* cited by examiner

*Primary Examiner* — Michael Barr
*Assistant Examiner* — Jason Riggleman
(74) *Attorney, Agent, or Firm* — McKenna Long & Aldridge LLP

(57) ABSTRACT

The present invention relates to laundry machines, such as washing machines or dryers, for washing or drying laundry. The steam generator (50) for a laundry machine includes a housing (80) formed to provide a space for holding water, a heater (55) for heating the water to generate steam, a water level sensor (60) for sensing a water level of the water held in the housing, and a stability maintaining member (70) for maintaining a stable state of the water at a portion to be sensed by the water level sensor (60).

10 Claims, 7 Drawing Sheets

STRUCTURE OF WATER LEVEL SENSOR FOR STEAM GENERATOR IN DRUM WASHING MACHINE

This application claims priority to International application No. PCT/KR2006/000919 filed on Mar. 15, 2006, and claims the priority benefit of Korean Application No. 10-2005-0042997 filed on May 23, 2005, Korean Application No. 20-2005-0014480 filed on May 23, 2005, and Korean Application No. 20-2005-0014484 filed on May 23, 2005, all of which are incorporated by reference, as if fully set forth herein.

TECHNICAL FIELD

The present invention relates to laundry machines, such as washing machines or dryers, for washing or drying laundry, and more particularly, to a steam generator for a laundry machine, in which washing water in the vicinity of a water level sensor is made to maintain a stable state for preventing the water level sensor from malfunctioning.

BACKGROUND ART

In general, the washing machine or a dryer is used for washing or drying laundry.

In the washing machines, there are pulsator type washing machines which washes laundry with water circulation generated as a disk shaped pulsator is rotated, and drum type washing machine which washes laundry by using head and friction of washing water and the laundry generated in a horizontal tub as the tub is rotated.

Recently, even a laundry machine is developed, in which steam is sprayed to wash or dry cleaning the laundry.

Of the various laundry machines, a drum type washing machine having the steam, generator will be described, as an example.

Referring to FIG. 1, a related art washing machine having a steam generator is provided with a cabinet 10 of an exterior of the washing machine, a cylindrical tub 20 horizontally supported in the cabinet 10 for holding washing water, a drum 30 rotatably mounted in the tub 20, a driving motor (not shown) for driving the drum 30, and a steam generator 50 for supplying steam to the drum 30.

The cabinet 10 has a laundry opening 13 in a front in communication pith an inside of the drum 30 for putting in/taking cut laundry, and a door 11 mounted so as to be rotatable in a front direction for opening/closing the laundry opening 13.

In the meantime, at one side of the drum type washing machine, there are a water supply valve 15 and a water supply hose 25 connected to an external water pipe (not shown) for supplying washing water to the tub 20.

The steam generator 50 is connected to the water supply hose 25 for introducing water thereto, and heats the water to generate steam to supply to the drum 30.

The steam generator 50 also has a steam supply pipe 53 at one side for guiding and spraying the steam generated at the steam generator 50 into the drum 30.

It is preferable that the steam supply pipe 53 has an end portion having a nozzle shape for smooth spray of steam into the drum 30, and it is preferable that the end portion is exposed to an inside of the drum 30 for discharging the steam thereto.

In the meantime, in order to prevent the steam sprayed into the inside of the drum 30 from making direct contact with the laundry, it is preferable that the steam supply pipe 53 is connected to one side of an upper side of the drum 30.

The steam generator 50 will be described in more detail Math reference to FIGS. 2 and 3.

Referring to FIG. 2, the steam generator 50 is provided with a lower housing 81 for forming an exterior and a space for holding water, an upper housing 82 coupled to an upper side of the lower housing 81, and a heater 55 for heating water held in the steam generator 50.

The upper housing 82 has a water inlet 52*a* at one side connected to the water supply valve for introduction of water into the steam generator 50, and an outlet 52*b* at the other side connected to a steam supply pipe 53 for supplying the steam generated thus to the drum 20.

Referring to FIG. 3, the heater 55 is mounted to a lower side of the upper housing 82, for heating the water submerged in the water completely once the water is introduced to the steam generator 50.

Mounted on one side of the upper housing 82, there are the water level sensor 60 for sensing the water level of the water therein, and a temperature sensor 57 for measuring temperatures of the water and steam heated by the heater 55.

The temperature sensor 57 also measures the temperature of the steam generated at the steam generator 50, and cuts off power to the heater 55 if the temperature is higher than a reference temperature, to prevent the heater 55 form overheating.

The water level sensor 60 measures the water level of the water in the steam generator 50, to maintain an appropriate level of water.

That is, if the water level of the water in the steam generator 50 is lower than the reference value, the water supply valve 15 is opened, to supplement the water, and, if the water level of the water in the steam generator 50 is higher than the reference value, the water supply valve 15 is closed, to stop the water supply, and put the heater 55 into operation to generate the steam.

In the meantime, the related art water level sensor 60 is provided with a receptacle housing 61 which is an exterior thereof and used for securing the related art water level sensor 60 to the steam generator 50, and electrodes 62, 63, and 64 extended downward to a lower side of the receptacle housing 61, for sensing the water level of the water in the steam generator 50.

The electrodes 62, 63, and 64 are mounted at appropriate heights from a bottom of the upper housing 82 for sensing the water level of the water in the steam generator 50.

However, the steam generator of the drum type washing machine has the following problems.

First, the water level sensors sense the Water level as the water connects electrodes of different lengths depending en the water level.

If the water boils heated by the heater to form bubbles, and is splashed to the water level sensor in a course the bubbles are formed and burst, the water formed between the electrodes serves to connect the electrodes of the water level sensor as the formation and bursting of the bubbles keeps taking place. According to this, the water level sensor mistakes in sensing the height of the water, to cause malfunction of the water level sensor.

Second, foreign matters introduced into the steam generator mixed with the water affects the water level sensor in the steam generator if the foreign matters deposit on the water level sensor.

That is, the foreign matters introduced into the steam generator from an outside thereof deposit on the water level sensor, to impair sensitivity and a mechanical lifetime of the water level sensor.

DISCLOSURE OF INVENTION

Technical Problem

An object of the present invention is to provide a laundry machine having a steam generator with a structure which can prevent malfunction of a water level sensor.

Technical Solution

The object of the present invention can be achieved by providing a steam generator for a laundry machine including a housing formed to provide a space for holding water, a heater for heating the water to generate steam, a water level sensor for sensing a water level of the water held in the housing, and a stability maintaining member for maintaining a stable state of the water at a portion to be sensed by the water level sensor.

The stability maintaining member is a partition formed to surround the water level sensor.

The partition separates the housing into a space having the heater mounted therein and a space having the water level sensor mounted therein.

Preferably, the partition surrounds the water level sensor.

The partition is spaced away from a bottom of the housing.

In the meantime, the water level sensor can measure a highest water level and a lowest water level, and includes a common electrode, a low water level electrode for measuring the lowest water level, and a high water level electrode for measuring the highest water level.

The partition surrounds the three electrodes of the water level sensor, individually.

The partition has a pass thrash hole at a position above a lowest end of the high water level electrode, for making rates of rise of the water levels at inside/outside of the partition the same.

The partition has a slit formed in a range from a lowest end of the low water level electrode to a lowest end of the high water level electrode.

In another aspect of the present invention, a steam generator for a laundry machine includes a housing having an upper housing and a lower housing coupled together to form a space for holding water, a heater in the lower housing for heating the water to generate steam, a water level sensor on the upper housing for sensing a water level of the water, and a partition in each of the upper housing and the lower housing for surrounding the water level sensor.

The water level sensor can measure a highest water level and a lowest water level.

At least one of the partitions of the upper housing and the lower housing surrounds the water level sensor, and the water level sensor includes a common electrode, a low water level electrode for measuring the lowest water level, and a high water level electrode for measuring the highest water level.

In this case too, the partition has a pass through hole at a position above a lowest end of the high water level electrode, for making rates of rise of the water levels at inside/outside of the partition the same.

The partitions on the upper and lower housings have slits ranging from a lowest end of the low water level electrode to a lowest end of the high water level electrode.

In this instance, the slit is formed only in the partition on the upper housing, or only in the partition on the lower housing, or both in the partitions on the upper housing and the lower housing.

The partition on the upper housing surrounds an outside of the partition on the lower housing, or the partition on the lower housing surrounds an outside of the partition on the upper housing.

The partition surrounds the three electrodes of the water level sensor, individually.

In another aspect of the present invention, a steam generator for a laundry machine includes a first space portion providing a space for holding water therein, and having a heater for heating the water held therein, a second space portion providing a space for holding water therein, and having a water level sensor for sensing a water level of the water, and a first communication portion for making the first space portion and the second space portion in communication for making rates of rise of the water held in the first space portion and the second space portion the same.

The steam generator further includes a second communication portion for making air pressures in the first space portion and the second space portion the same.

In this case too, the water level sensor includes a common electrode, a low water level electrode for measuring the lowest water level, and a high water level electrode for measuring the highest water level.

Advantageous Effects

The present invention can solve the related art problems.

That is, by making the heated washing water in the vicinity of the water sensor to maintain a stable state, the present invention prevents malfunction of the water level sensor likely to cause by the bubbles formed as the water boils.

Accordingly, an increased power consumption liable to cause by malfunction or damage to product caused by overload of the heater can be prevented.

Furthermore, by protecting the water level sensor from foreign matters introduced from an outside of the steam generator thereto, a mechanical lifetime of the water level sensor can be extended.

DESCRIPTION OF SYMBOLS FOR KEY PARTS IN THE DRAWINGS

Figure 1:
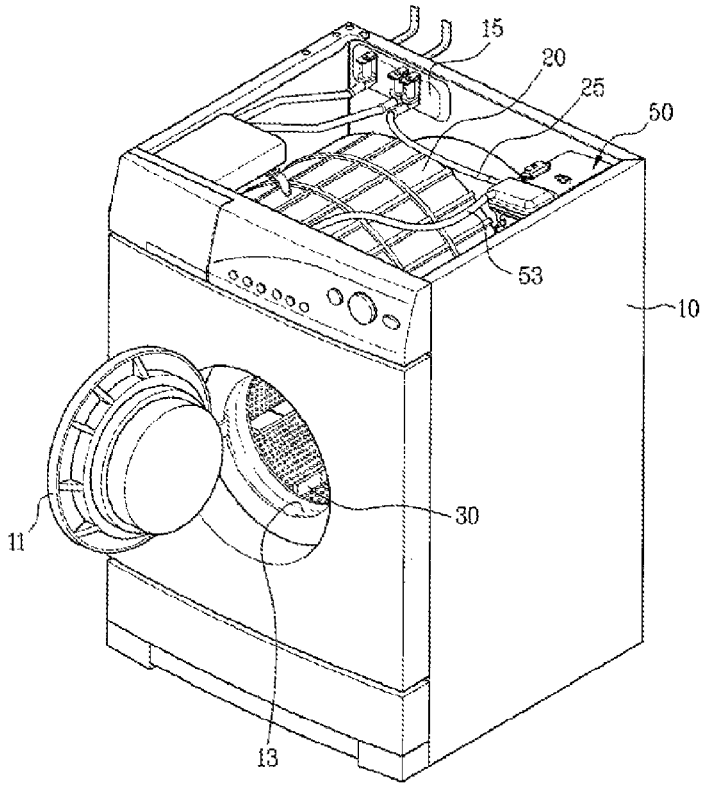
FIG. 1 PRIOR ART
FIG. 1 illustrates a perspective view of a related art drum type washing machine; schematically.
Figure 2:
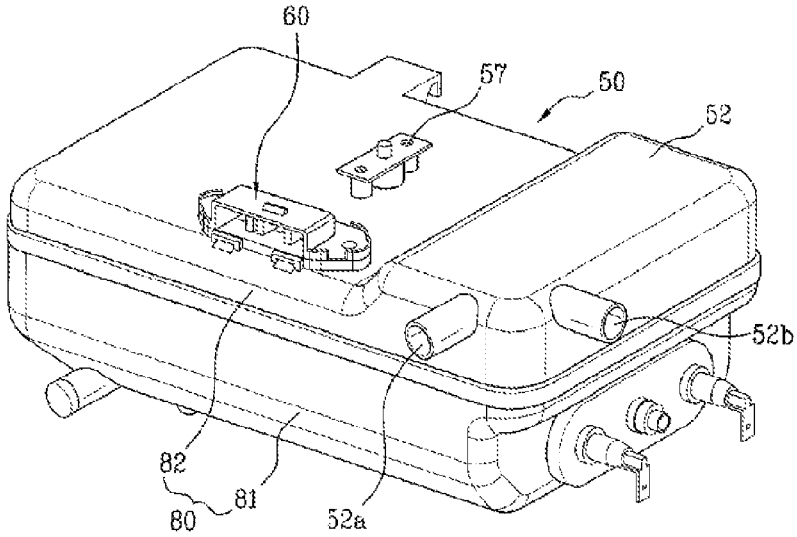
FIG. 2 PRIOR ART
FIG. 2 illustrates a perspective view of a steam generator for a related art drum type washing machine.
Figure 3:
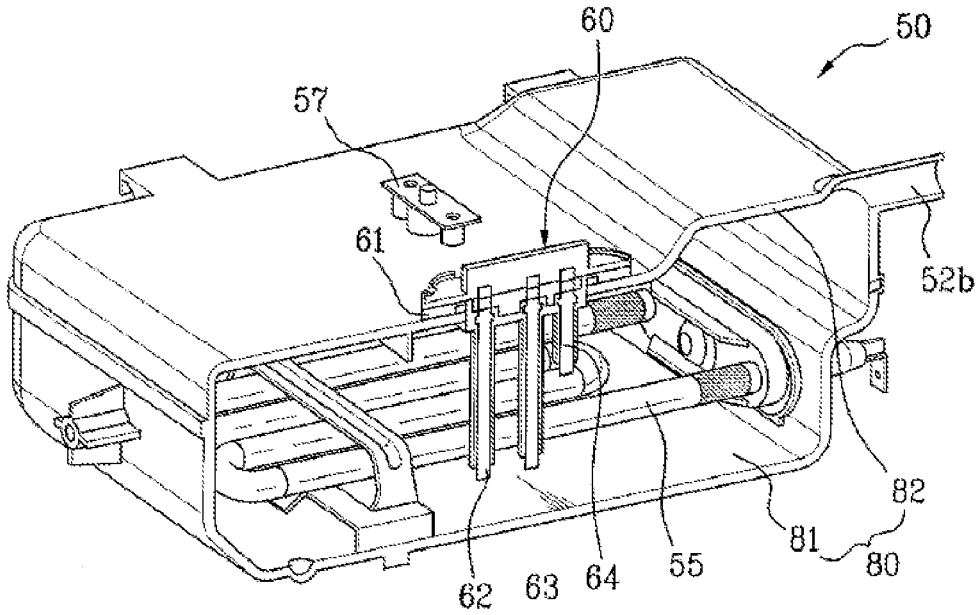
FIG. 3 PRIOR ART
FIG. 3 illustrates a perspective view showing an internal structure of the steam generator in FIG. 2.

50: steam generator
55: heater
57: temperature sensor
60: water level sensor
61: receptacle housing
62: common electrode
63: low water level electrode
64: high water level electrode
70: partition
80: housing
81: lower housing
82: upper housing

BEST MODE FOR CARRYING OUT THE INVENTION

Reference will now be made in detail to the preferred embodiments of the present invention, examples of which are illustrated in the accompanying drawings.

For convenience sake, of various laundry machines, a drum type washing machine will be shown and described.

A steam generator for a laundry machine in accordance with a first preferred embodiment of the present invention will be described with reference to FIGS. 4 and 5.

Figure 4:
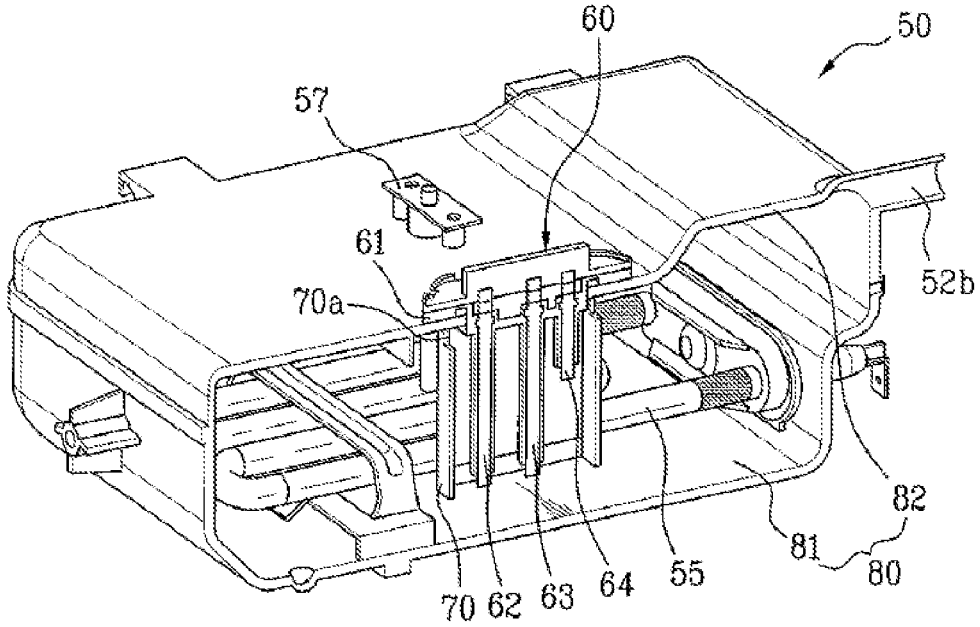
FIG. 4 illustrates a perspective view showing an internal structure of a steam generator in accordance with a first preferred embodiment of the present invention.
Figure 5:
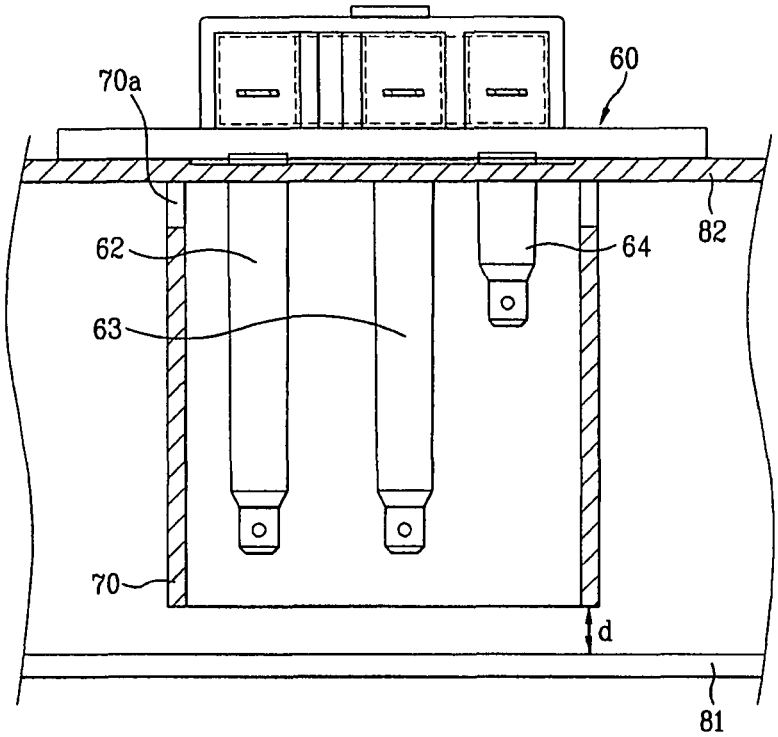
FIG. 5 illustrates a section of a key part of the water sensor unit in FIG. 4.

Referring to FIGS. 4 and 5, the steam generator includes a housing 80 having a space for holding water, a heater 55 for heating the water to generate steam, a water level sensor 60 for sensing a water level of the water, and a stability maintaining member for maintaining a stable state of the water at a portion to be sensed by the water level sensor.

In this instance, as the stability maintaining member for preventing the bubbles formed as the water is heated by the heater 55 from splashing to the water level sensor 60 directly, a partition is used for separating a portion of the housing having the water level sensor 60 mounted therein from the other portion of the housing.

On an outside of the housing 80 that is an exterior of the steam generator and holds the water, there is a receptacle housing 61, and the water level sensor 60 is mounted under the receptacle housing 61.

The water level sensor has a plurality of electrodes 62, 63, and 64.

For measuring a temperature of an inside of the steam generator, there is a temperature sensor 57 mounted on an outside of the housing 80, and there is a partition 70 in the housing 80 around the electrodes 62, 63, and 64.

In the meantime, the housing 80 has an upper housing 82 and a lower housing 81 coupled together, and the receptacle housing 61 is mounted from an outside of the upper housing such that the electrodes 62, 63, and 64 are placed in the housing 80.

As shown, the partition is around the electrodes 62, 63, and 64 in the upper housing 82.

Referring to FIG. 4, the partition in the steam generator for a laundry machine in accordance with a first preferred embodiment of the present invention surrounds the water sensor and has an opened bottom.

The partition 70 is spaced away a predetermined distance d from a bottom of the upper housing 82, permitting the water in the steam generator to flow into an inside of the partition 70.

Then, the water flowing into the inside of the partition 70 through the opened bottom thereof fills up the inside of the partition 70 along the plurality of electrodes 62, 63, and 64 of the water sensor, raising the water level.

In the meantime, in the receptacle housing 61, there are a common electrode 62, a lower water level electrode 63, and a high water level electrode 64 as water level sensors for measuring the water level.

The electrodes 62, 63, and 64 are mounted at appropriate heights for sensing the water levels of the water in the steam generator 50, respectively.

For an example, the electrodes 62, 63, and 64 are the common electrode 62 which is a reference electrode for sensing the water level, the low water level electrode 63 for sensing a low water level, and the high water level electrode 64 for sensing a high water level.

It is required that the common electrode 62 has a length at least the same, or longer than a length of the low water level electrode 63.

If the common electrode 62 and the low water level electrode 63 are submerged under the water in the steam generator 50, the water level sensor 60 generates a low water level signal as current flows through the water.

If the water level rises to submerge the high water level electrode 64, the water level sensor 60 generates a high water level signal.

Referring to FIG. 5, since the water can not flow into the inside of the partition 70 if an air pressure builds up in the partition 70, there is a pass-through hole 70*a* in an upper side of the partition 70, particularly, at a position higher than a bottom end of the high level electrode 64.

In the meantime, FIGS. 6 to 11 illustrate steam generators for laundry machine in accordance with another embodiments of the present invention, respectively.

That is, as shown in the attached drawings, the steam generators are also for direct introduction of the washing water into an inside of the partition 70, and smooth measurement of the water level of the water introduced to the inside of the partition 70 by the water level sensor 60. What is different from the first embodiment is that slits 70*b* or 70*c* are provided instead of the pass through hole 70*a* in the partition 70.

Figure 6:
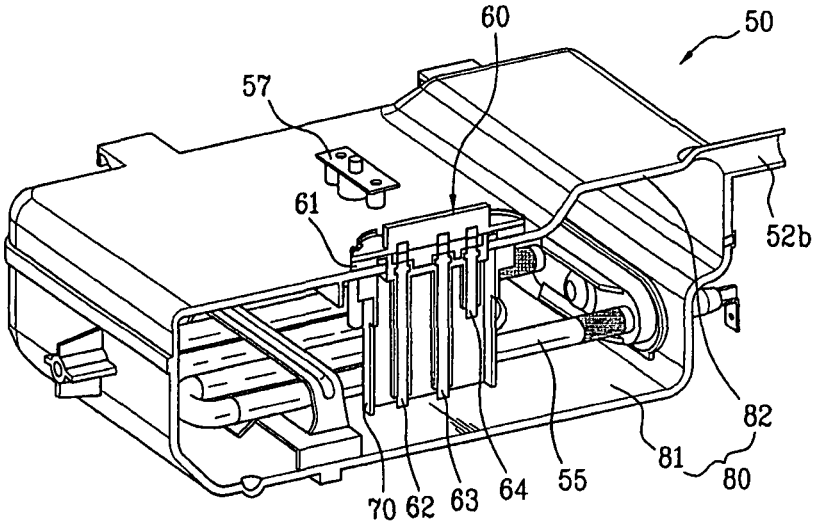
FIG. 6 illustrates a perspective view showing an internal structure of a steam generator in accordance with a second preferred embodiment of the present invention.
Figure 7:
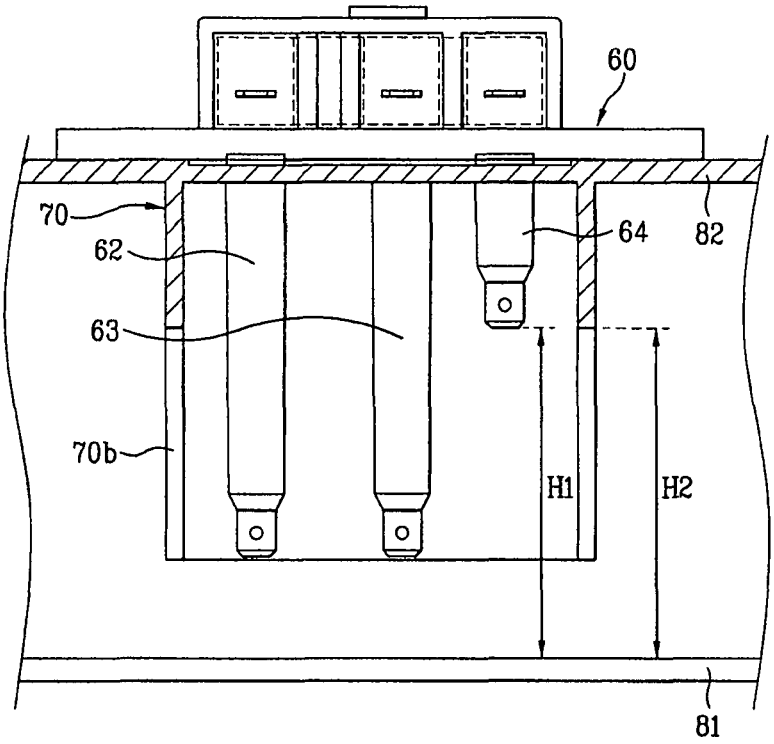
FIG. 7 illustrates a section of a key part of the water sensor unit in FIG. 6.

That is, referring to FIGS. 6 and 7, the steam generator for a laundry machine in accordance with a second preferred embodiment of the present includes a partition 70 on the upper housing 82, and a vertical slit 70*b* in a side wall of the partition 70.

In this instance, in order to measure from a lowest water level to a highest water level, at least a length H2 from a bottom of the upper housing 82 to the slit is greater than a length H1 from the bottom of the upper housing 82 to a lowest end of the high water level electrode 64.

Figure 8:
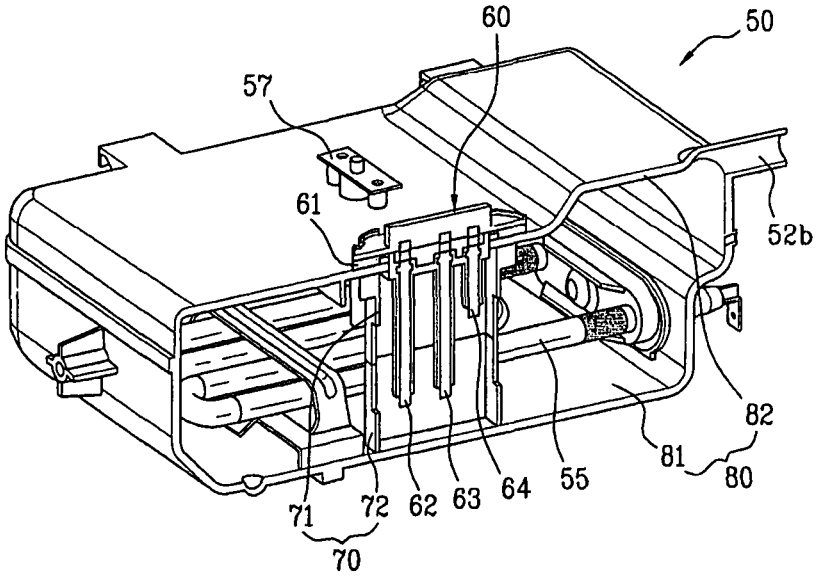
FIG. 8 illustrates a perspective view showing an internal structure of a steam generator in accordance with a third preferred embodiment of the present invention.
Figure 9:
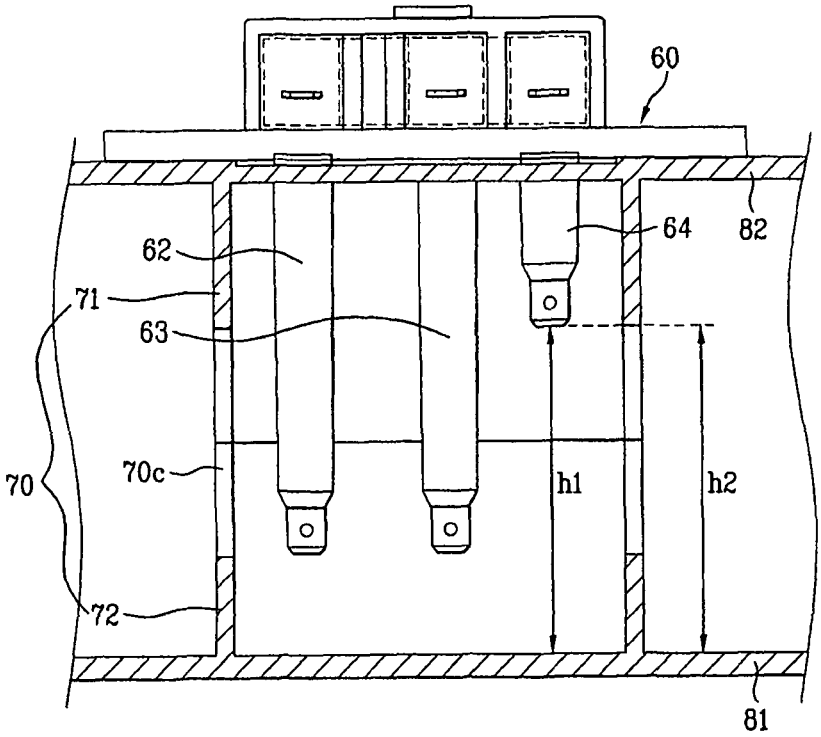
FIG. 9 illustrates a section of a key part of the water sensor unit in FIG. 8.

FIGS. 8 and 9 attached hereto illustrate steam generators in accordance with a third preferred embodiment of the present invention, respectively.

Referring to FIGS. 8 and 9, the steam generator includes a partition 70 formed on an upper housing 82, and a lower housing 81 respectively opposite to each other, and a slit 70*c* formed in the partition 70 on the upper, and lower housings 82, and 81 to include the lowest end of the low water level electrode 63 to the lowest end of the high water level electrode 64.

In this instance, as shown, it is preferable that the slit 70*c* is formed in each of the partitions 71 and 72 on the upper housing 82 and the lower housing 81 respectively opposite to each other so as to be continuous from each other.

Of course, though not shown, the slit may be formed in one of the upper, and lower partitions 71, and 72, such that one partition without the slit does not block the other partition having the slit formed therein (refer to a description below).

In this case, for reinforcing a structure of the partition 70, the partition 70 on the upper housing 82 may be formed to surround an outside of the partition 70 on the lower housing 81, or vice versa.

Figure 10:
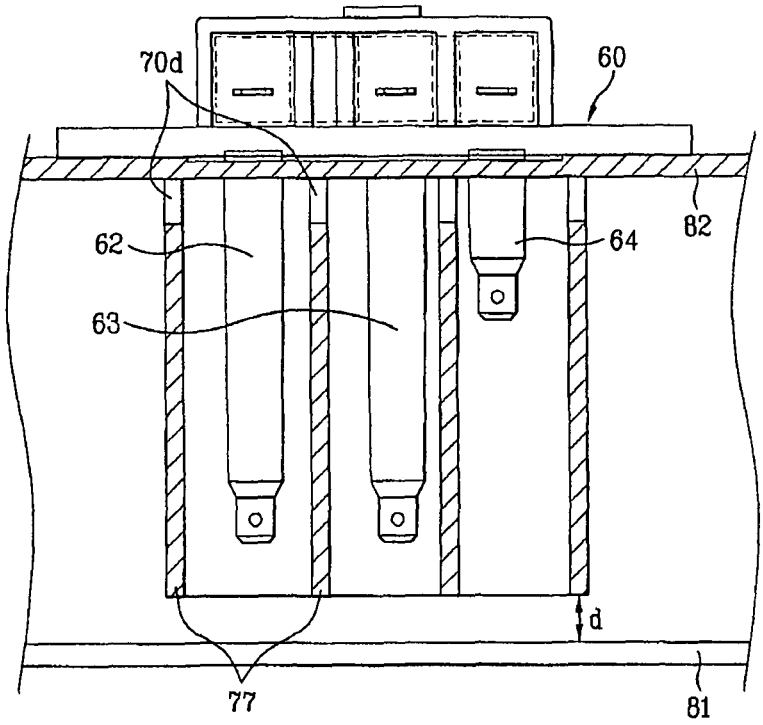
FIG. 10 illustrates a perspective view showing an internal structure of a steam generator in accordance with a fourth preferred embodiment of the present invention.
Figure 11:
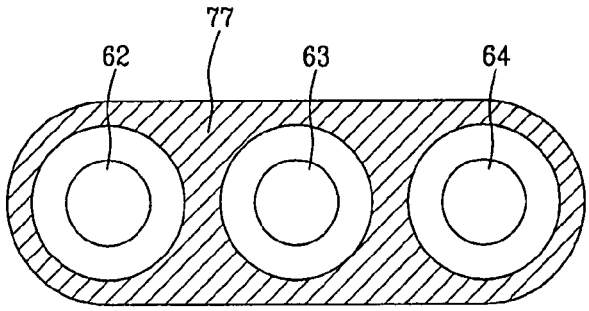
FIG. 11 illustrates a section of a key part of the water sensor unit in FIG. 10.

Referring to FIGS. 10 and 11 attached hereto, different from the foregoing embodiments, the partition 77 surrounds the plurality of electrodes 62, 63, and 64 one by one.

In this case too, the partition 77 is spaced away a predetermined distance d from a bottom of the lower housing 81, and has an opened bottom and a pass through hole 70*d* in an upper side of the partition 77, for enabling the water level to rise at a speed the same with an outside of the partition 77.

Of course, in this case too, though not shown in detail, the pass through hole 70*d* or the slit may be formed.

Figure 12:
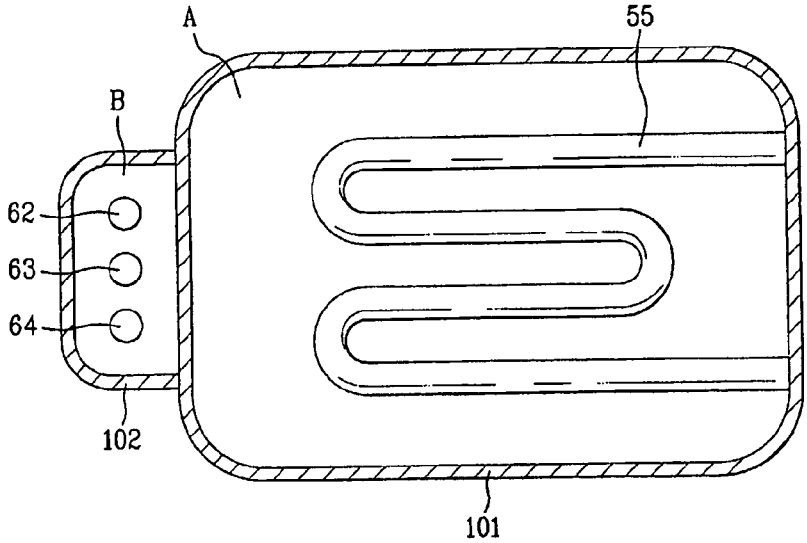
FIG. 12 illustrates a sectional plan view showing an internal structure of a steam generator in accordance with a fifth preferred embodiment of the present invention.
Figure 13:
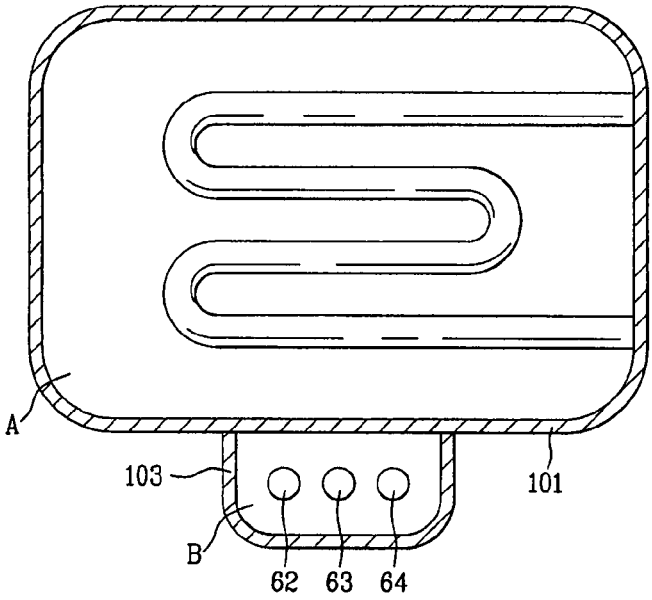
FIG. 13 illustrates a sectional plan view showing an internal structure of a steam generator in accordance with a fifth preferred embodiment of the present invention.
Figure 14:
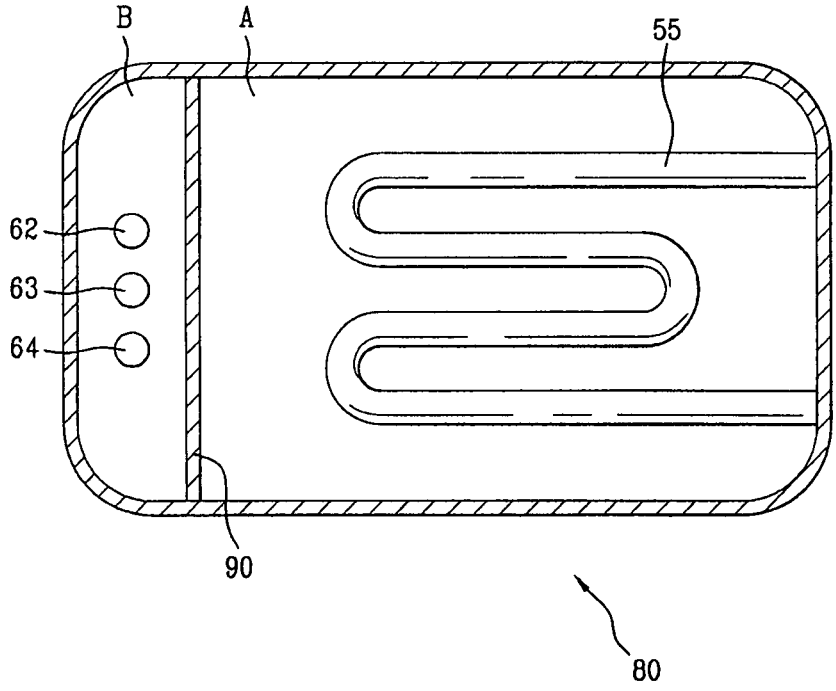
FIG. 14 illustrates a sectional plan view showing an internal structure of a steam generator in accordance with a sixth preferred embodiment of the present invention.

In the meantime, FIGS. 12, 13, and 14 illustrate structures each having housings 101, and 102 of two separated spaces A, and B, for placing the heater 55 in the housing 101 of the first space A, and the water level sensor 60 in the housing 102 of the second space B.

In this case too, between the housing 101 of the first space A and the housing 102 of the second space B, there are a first pass through hole (not shown) and a second pass through hole (not shown) in an upper side and a lower side respectively, enabling the water levels to rise at the same speeds in both spaces.

FIG. 14 illustrates a housing divided into to spaces by a partition 90 at a center.

The operation of the steam generator for a laundry machine in accordance with the present invention will be described.

Upon inputting a washing process, the washing water is introduced into the steam generator 50 through the water supply hose 25 (See FIG. 1).

Then, the heater 55 is operated, to heat the washing water.

In this case, it is preferable that a control unit provided to the laundry machine is programmed such that the heater 55 is designed to be turned on only when the washing water is filled to a water level higher than a minimum required water level, and turned off by the temperature sensor 57 when the temperature sensor 57 senses that a temperature of the washing water reaches to a predetermined temperature.

Then, the washing process is progressed as the steam generated from the washing water heated thus is introduced into the drum 30 through the steam supply pipe 53.

That is, the steam is sprayed onto the laundry directly, to perform soaking, sterilizing, and dry cleaning of the laundry.

In the meantime, at the time of introduction of the washing water into the steam generator 50, the washing water is also introduced into an inside of the partition through the opening in a lower side of the partition or the slit in the partition at a rising speed of the water level the same with an outside of the partition.

According to this, the common electrode 62 and the low water level electrode 63 in the partition 70 are submerged under the washing water introduced into the partition, and a low water level or a high water level is sensed as a current is made to flow among the electrodes 62, 63, and 64 by the washing water.

That is, if the water level in the steam generator 50 rises gradually such that the water level reaches to the lowest end of the high water level electrode 64, the current is made to flow to generate the high water level signal.

In the meantime, the washing water introduced to the steam generator boils generating lots of bubbles if the washing water has a temperature higher than a certain temperature when the washing water is heated by the heater. As shown in the drawings, the water level sensor within the partition is mounted at a place different from the heater in the plan views.

Therefore, the bubbles formed on the washing water by the heater do not move toward the electrodes directly.

In conclusion, the washing water within the partition 70 is in a state only a temperature thereof is elevated enough to generate the steam, but to maintain a stable state without generation of the bubbles.

That is, though in a structure without the partition, the washing water boils up and is splashed among the electrodes, to cause malfunction in water level sensing of the water level sensor, in a case of a steam generator having a partition around a water level sensor like the present invention, because the washing water is stable in the vicinity of the electrodes, the malfunction of the water level sensor can be prevented, which is caused by boiling of the washing water.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

The present invention relates to laundry machines, such as washing machines or dryers, for washing or drying laundry, and more particularly, to a steam generator for a laundry machine, for smooth operation of a water level sensor in the steam generator.

The partition around the water level sensor prevents bubbles formed from the washing water heated by a heater from reaching to a neighborhood of the water level sensor.

That is, by making the washing water in contact with the water level sensor to maintain a stable state, malfunction of the water level sensor at the time of water level sensing can be prevented.

The invention claimed is:

1. A steam generator for a laundry machine comprising:

a housing having an upper housing and a lower housing coupled together to form a space for holding water;

a heater in the lower housing for heating the water to generate steam;

a water level sensor on the upper housing for sensing a water level of the water;

a partition including three electrodes and formed on the upper housing and the lower housing respectively opposite to each other; and a slit formed in both the partition of the upper housing and the lower housing, wherein the partition surrounds all electrodes totally in longitudinal direction of the three electrodes except the slit.

2. The steam generator as claimed in claim 1, wherein at least one of the partitions of the upper housing and the lower housing surrounds the water level sensor.

3. The steam generator as claimed in claim 1, wherein the water level sensor includes;

a common electrode, a low water level electrode having the same length as or shorter length than a length of the common electrode for measuring the lowest water level, and a high water level electrode having shorter length than a length of the low water level electrode for measuring the highest water level.

4. The steam generator as claimed in claim 3, wherein the partitions on the upper and lower housings have slits ranging from a lowest end of the low water level electrode to a lowest end of the high water level electrode.

5. The steam generator as claimed in claim 3, wherein the partition on the upper housing has a slit.

6. The steam generator as claimed in claim 5, wherein the slit ranges from a lowest end of the low water level electrode to a lowest end of the high water level electrode.

7. The steam generator as claimed in claim 4, wherein the slit is formed both in the partitions on the upper housing and the lower housing.

8. The steam generator as claimed in claim 1, wherein the partition on the upper housing surrounds an outside of the partition on the lower housing.

9. The steam generator as claimed in claim 1, wherein the partition on the lower housing surrounds an outside of the partition on the upper housing.

10. The steam generator as claimed in claim 9, wherein the partition surrounds the three electrodes of the water level sensor, individually.

* * * * *